US006868694B2

(12) United States Patent
Nielsen

(10) Patent No.: US 6,868,694 B2
(45) Date of Patent: Mar. 22, 2005

(54) DRY ICE DRINKING VESSEL

(76) Inventor: Peter Nielsen, 7327 N. McKinley Ave., Kansas City, MO (US) 64158

( * ) Notice: Subject to any disclaimer, the term of this patent is extended or adjusted under 35 U.S.C. 154(b) by 41 days.

(21) Appl. No.: 10/645,019

(22) Filed: Aug. 21, 2003

(65) Prior Publication Data

US 2004/0035144 A1 Feb. 26, 2004

Related U.S. Application Data

(60) Provisional application No. 60/405,468, filed on Aug. 22, 2002.

(51) Int. Cl.[7] ..... F25D 3/08; F25D 3/02

(52) U.S. Cl. ..... 62/457.3; 62/457.4; 62/460

(58) Field of Search ..... 62/457.3, 460, 62/457.4, 388

(56) References Cited

U.S. PATENT DOCUMENTS 2,105,339 A 1/1938 Sweitzer
2,464,522 A * 3/1949 McDonald ..... 62/332
3,910,461 A * 10/1975 Eager ..... 222/131
4,170,320 A * 10/1979 Eagar ..... 222/146.6
4,782,670 A * 11/1988 Long et al. ..... 60/457.4
5,749,500 A * 5/1998 Kraus et al. ..... 222/377

* cited by examiner

*Primary Examiner*—William C. Doerrler
*Assistant Examiner*—Filip Zec

(57) ABSTRACT

A drinking vessel includes an interior portion that holds pellets or chips of dry ice that cool a beverage in the glass while the beverage is being consumed. The interior portion can be a part of the glass or it can be a detached piece usable in different vessels. Either way the interior portion includes holes that allow the beverage to freely flow around the dry ice while the holes are small enough to prevent the dry ice from entering the portion of the vessel where it could be accidentally consumed.

20 Claims, 5 Drawing Sheets

DRY ICE DRINKING VESSEL

CROSS REFERENCE RELATED APPLICATIONS

This application claims priority under 35 USC 119(e) of provisional patent 60/405,468 filed Aug. 22, 2002.

BACKGROUND OF THE INVENTION

It has been common practice to use dry ice, solidified $CO_2$, as a cooling agent Dry ice can be dangerous to touch, but is commonly used in shipping perishable items for example. Dry ice is commonly available today in many grocery stores as well as other locations. Dry ice is available in block form and also in pellets. It is known to use dry ice to cool beverages. For example U.S. Pat. No. 2,105,339 to Sweitzer discloses dry ice used to cool a portable dispenser for beverages. The insulated dispenser of Sweitzer includes an internal container into which dry ice is placed. The dispenser is then filled with a beverage. The dispenser provides cooling and also carbonation and has a valve to control pressure. Prior art dispenser devices such as the Switzer device filled a need for cool beverages but were only practical where beverage was to be served to a large number of people from the single dispenser. A problem with a large dispenser like the Switzer device is that once an individual drink is served it will begin to warm up because it is no longer in contact with the dry ice. Another disadvantage of the prior art is that people can not see the dry ice.

As can be seen there is a need for an individual drink vessel that can be used to cool a drink with dry ice.

SUMMARY OF THE INVENTION

The present invention relates to a drinking vessel made to be cooled by dry ice. Specifically the present invention allows the user to enjoy both the cooling effects of dry ice and also to enjoy its curious properties such as its emission of cloudy vapors and the movement of the dry ice within a warmer liquid as the dry ice is propelled by its own vapor. The disclosed device provides a method of cooling a drink with dry ice that is safe and easy for individual servings.

DETAILED DESCRIPTION OF THE DEVICE

Figure 1:
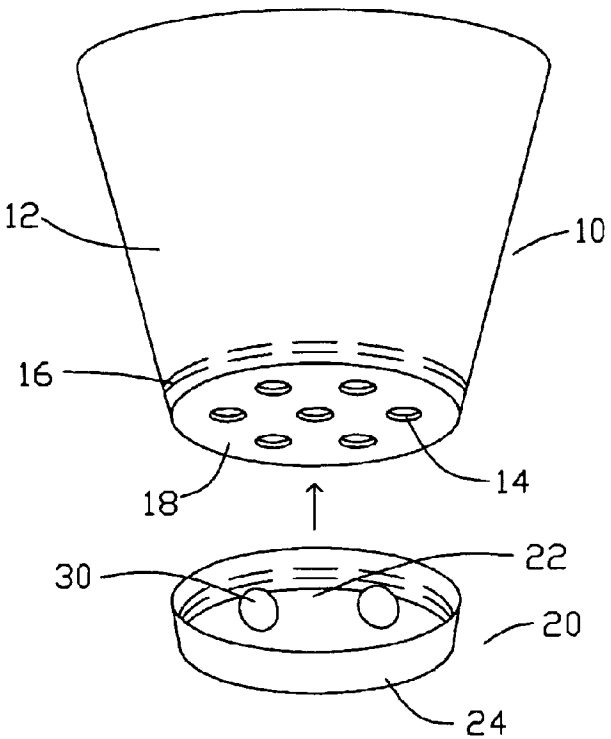
FIG. 1 shows an exploded view of the drinking glass.

FIG. 1 shows an exploded view of the drinking vessel as it would appear when being assembled by a user. The vessel (10) is in the form of a small drinking container such as might be used in drinking alcoholic "shots". The upper portion of the glass (12) includes a bottom surface (18) with holes (14). The upper portion (12) also includes structure such as threads (16) that will allow for the bottom portion (20) to be attached. The embodiment of FIG. 1 shows threads (16) as the means of attachment. The bottom portion (20) includes a bottom (22). and a cylindrical side wall (24) that is also threaded. Dry ice pellets (30) are shown in the bottom portion (20). Once threaded in place there is a space between the bottom (18) of the upper portion (12) and the bottom (22) of the lower portion (20) and that space holds the dry ice pellets (30).

In use the dry ice pellets (30) are placed in the bottom portion (20) and the bottom portion is threaded on to the top portion (12). An individual serving of beverage such as alcohol can then poured into the top portion (12) of the vessel (10). Holes (14) allow the beverage to circulate through the bottom portion (20) of the vessel (10) to cool but the holes (14) are sized small enough that the dry ice pellets (30) can not enter the upper portion (12) where the user might accidentally drink them. In practice it has been found that a hole of about ⅛ inch in diameter will hold the dry ice pellets in place in the lower cavity until the pellets are small enough to not be able to hurt the user if they get into the beverage.

The upper (12) and bottom (20) portions of the vessel (10), can be made from a variety of clear or translucent materials such as glass, polypropylene or acrylic. The material chosen for the upper and bottom portions can be a non-insulating material. The connection between the upper and lower portion is shown as a threaded connection but any of a number of other connections such as a press fit or snap lock connection might be used. Any connection could be supplemented with a seal to prevent leaks.

Figure 2:
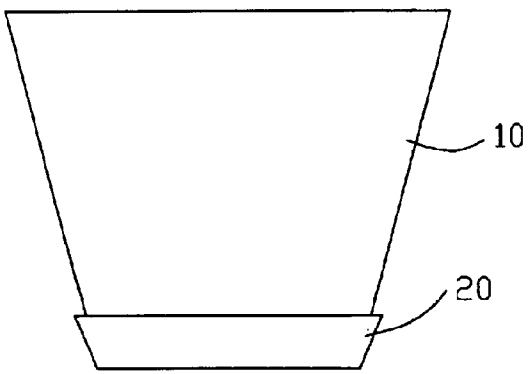
FIG. 2 shows a view of the drinking glass assembled.

FIG. 2 shows the shot glass vessel (10) assembled with the bottom portion 20 in place.

Figure 3:
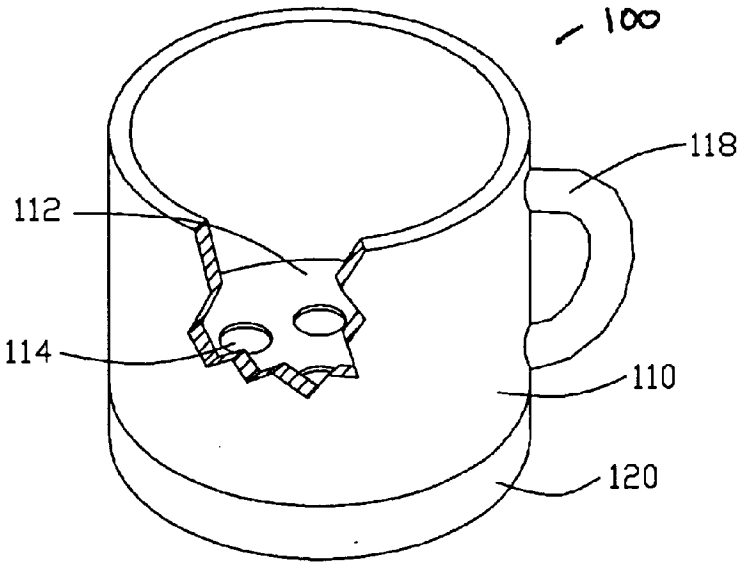
FIG. 3 shows a broken view of a handled mug embodiment.

FIG. 3 shows a partial cross sectional view of an alternative embodiment of a drinking vessel (100) including an upper portion (110) and a lower portion (120). FIG. 3 shows the drinking vessel (100) assembled for use. The upper portion (110) includes a bottom (112) having holes (114) to allow a beverage to pass through. This embodiment includes a handle (118) such as might be used on a beer mug. Again the upper and lower portions can be assembled in any manner that would prevent leaks. If used in a bar it may be desirable to be able to take the lower portion (120) back off the upper portion (110) so that the vessel (100) can be washed and reused.

Figure 4:
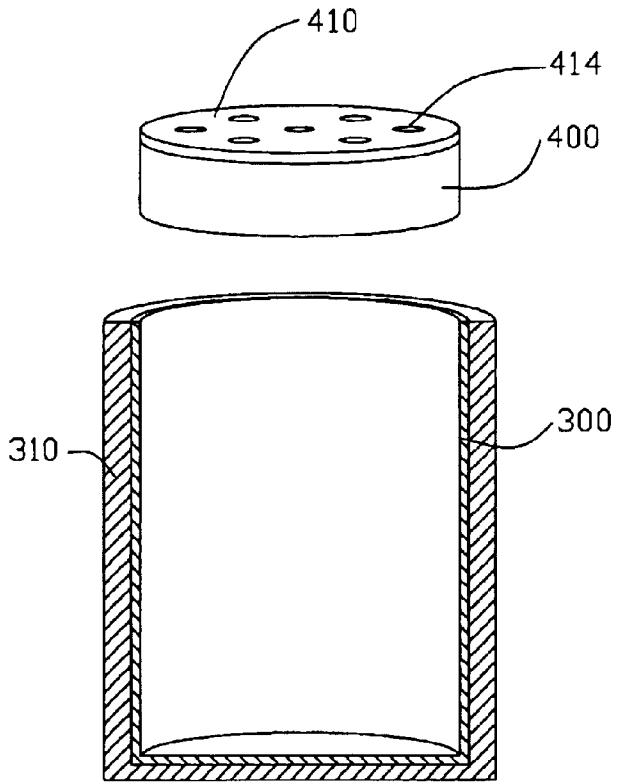
FIG. 4 shows another embodiment.

FIG. 4 shows another embodiment drinking vessel (400). In this embodiment a regular drinking vessel (300) which might include an insulating jacket (310) is used to contain a beverage for consumption. A cylindrical container (400) is used to hold the dry ice pellets (30 from FIG. 1). A lid portion (410) includes holes (414). The diameter of the cylindrical container (400) is smaller then the diameter of the drinking vessel (300) such that the cylindrical container can be placed inside the drinking vessel (300).

Use of the embodiment of FIG. 4 would involve removing the lid portion (410) and placing the dry ice pellets (30 in FIG. 1) inside the container (400). The container (400) is then dropped into the standard drinking vessel glass (300). The beverage to be consumed is then poured into the vessel (300) . Holes (414) allow the beverage to circulate and cool while the holes (414) keep the dry ice in place.

Figure 5:
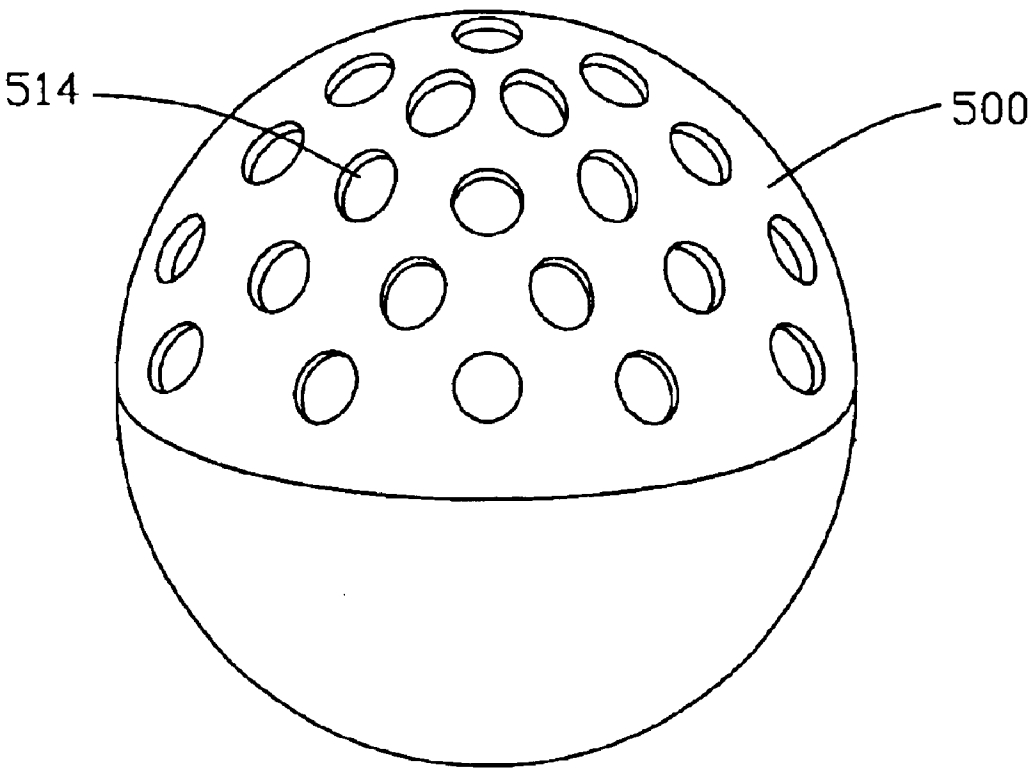
FIG. 5 shows yet another embodiment of the device.

FIG. 5 shows another embodiment where a sphere (500) is used to contain dry ice. The sphere includes holes (514). The sphere (500) can be dropped into any drinking vessel. The sphere (500) is small enough to fit into most vessels but large enough that it could not be accidentally drank. It is envisioned that the sphere (500) would be about 1 inch in diameter. The sphere (500) could be manufactured in two halves that could be opened or it could be a one piece design. In the one piece design the dry ice would be formed inside the spherical shell during the dry ice manufacturing process.

As a one piece design the spheres (500) would be sold in stores ready to use and once used the empty spheres would be disposable or could be recycled back to the manufacturer.

Figure 6:
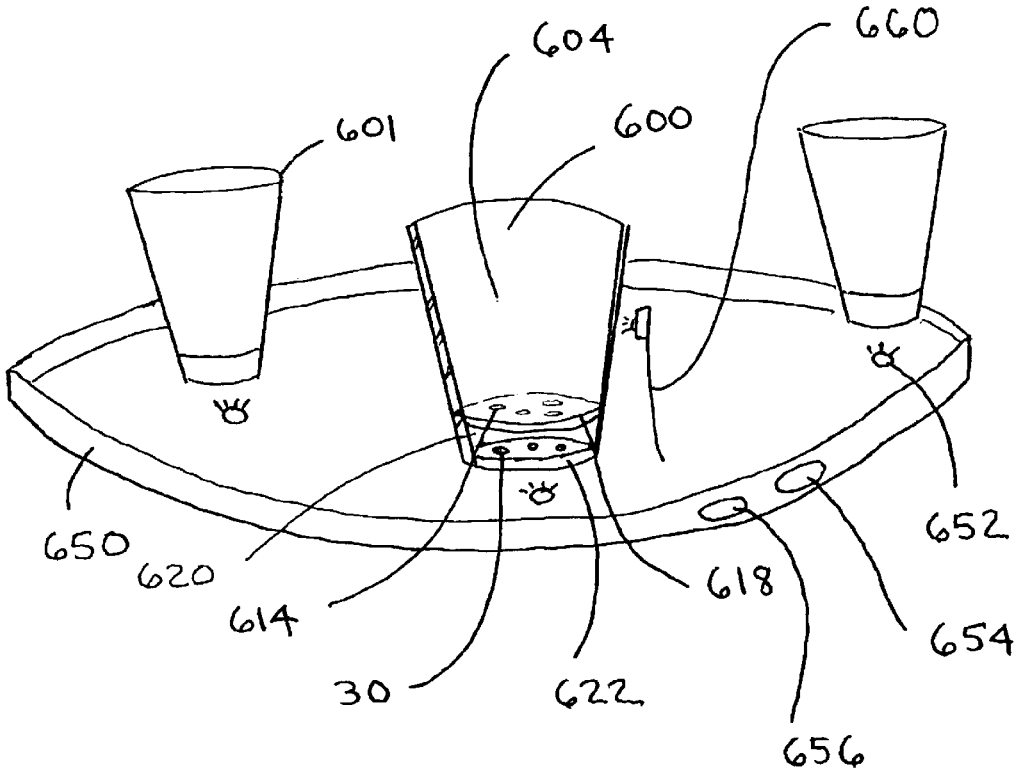
FIG. 6 shows yet another embodiment of the device partially in cross section including a serving tray.

FIG. 6 shows an alternate embodiment. A drinking vessel (600) can include a bottom (618) including holes (614) that allow beverage to flow through. Dry ice pellets (30) can be contained in a space formed by plug (622) that can be inserted into a bottom portion (620) of the vessel (600). $CO_2$ gas released from the dry ice pellets (30) will bubble to the surface of the liquid and can exit from the open rim (610) of the vessel. A tray (650) can be used to carry the drinking vessels (600). The tray (650) can be transparent and light display (652) in the tray (650) can be used to further enhance the effect. The tray (650) can include a battery (654) to power the light display (652). Electronic circuit (656) can be used to control the light displays (652) to provide different colors or flashing effects. The tray (650) can be used in a bar atmosphere to enhance the sales of drinks contained in the vessels (600). It has been found that if a different colored light shot into the top portion (604) and bottom portion (620) that the bottom (618) will separate the light reflected out of the drinking vessel (600). Therefore if a light (652) shines a blue light into the bottom portion (620) and the light (660) shines a red colored light into the top portion (604), the bottom (618) will keep the red and blue lights separate so that the vessel (600) will have an interesting multi-color look that will enhance the visibility of the vapor bubbles coming off the dry ice, rising through the liquid and discharging as a vapor around the vessel rising out of the open rim (601) of the vessel (600). A lighted tray (650) could be used with any of the vessels shown in the other embodiments.

Figure 7:
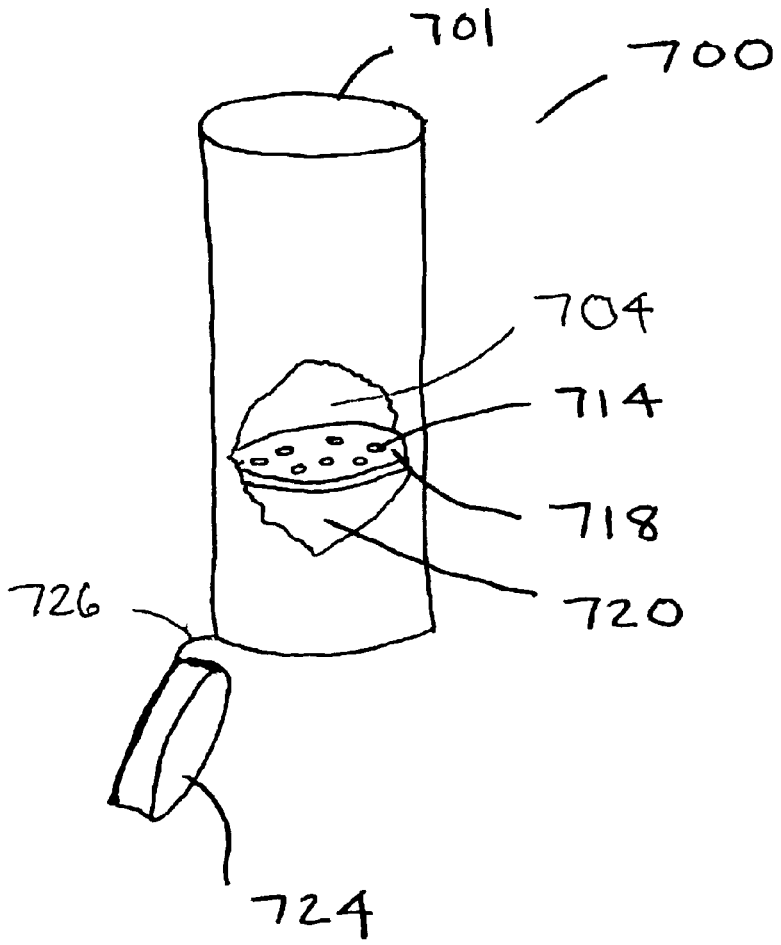
FIG. 7 shows another embodiment in partial cross section.

FIG. 7 shows an alternate design vessel (700). The vessel (700) can be made of translucent polypropylene. The vessel (700) can have an open rim (701) through which $CO_2$ vapor will rise and through which a beverage can be drank. In this embodiment the vessel (700) is molded from a single piece of polypropylene. The upper portion (704) is separated from the lower portion (720) by a bottom (718) that has holes (714). In this embodiment a cap portion (724) can be integrally molded with the vessel (700) and can include a living hinge (726) that will keep the cap (724) connected with the vessel (700). In this embodiment the one piece design is very inexpensive to mold. Once the cap (724) closes the lower portion, with dry ice pellets in the lower portion it is not possible to easily reopen the lower portion (720). Thus in a bar serving drinks using the vessel (700) once the vessel (700) is served with dry ice in the lower cavity it will not be possible to remove that dry ice. Once the beverage is consumed the vessel (700) can be disposed.

Although shown in use with dry ice pellets it is well known to provide dry ice in other forms such as chips off a large block. Both pellets and blocks are commonly available. Experimentation has shown that a plurality of small holes in the range from 1/16 inch up to 1/4 inch diameter will work. Eventually the pellet of dry ice will get small enough to pass through the hole but experimentation has shown that such a small piece of dry ice is too small to harm a user or to even cause discomfort if it were accidentally consumed. In addition to forming a plurality of individual holes it would also be possible to use a material such as screen or mesh for the bottom (18).

What is claimed is:

1. An open rimmed drinking vessel for containing a serving of liquid to be cooled by dry ice and drank wherein;

said vessel includes an upper portion defining an interior space, an interior wall portion is held inside said upper portion, said interior wall defining a first space and a second space held within said interior space;

dry ice held within said second space;

at least one hole in said interior wall allows a portion of said liquid to pass through said interior wall from said first space to said second space such that said portion of said liquid contacts and is cooled by said dry ice prior to being consumed.

2. The drinking vessel of claim 1 wherein the vessel is made of clear material.

3. The drinking vessel of claim 2 wherein a portion of said second space can be removed from said drinking vessel to facilitate placing dry ice in said second space.

4. The drinking vessel of claim 1 including a lighted tray to serve said second drinking vessel from.

5. The drinking vessel of claim 3 wherein said portion of said second space can be sealingly fit into a cavity on said vessel to form said second space.

6. The drinking vessel of claim 1 wherein said interior wall is near the bottom of said vessel.

7. The drinking vessel of claim 1 wherein said second space is a sphere and said interior wall is a sphere.

8. The drinking vessel of claim 1 wherein $CO_2$ released from said dry ice exits said second space through said at least one hole.

9. The drinking vessel of claim 2 wherein the clear material is acrylic.

10. The drinking vessel of claim 1 wherein the vessel is molded from a single shot of material.

11. The drinking vessel of claim 10 wherein the material is polypropylene.

12. The method of serving a drink including the steps of;

placing dry ice pellets in a cavity having at least one wall with at least one hole passing through said at least one wall, said hole being sized to prevent movement of said dry ice pellets through said hole;

placing said cavity in liquid communication with a clear drinking vessel such that liquid can pass from the drinking into contact with the dry ice pellets through said at least one hole;

pouring a serving of liquid into the clear drinking vessel;

allowing released $CO_2$ gas to exit an open rim of said vessel.

13. The method of claim 8 including the step of placing said clear drinking vessel on a lighted tray.

14. The method of claim 12 wherein the step of placing said cavity in liquid communication includes the steps of placing dry ice pellets in said cavity and sealing said cavity with a cap.

15. The method of claim 14 wherein said cap is integrally formed with said vessel.

16. A drinking vessel for containing a serving of liquid to be cooled by dry ice an drank wherein;

said vessel includes an upper portion interior space adapted to contain liquid, an interior wall portion is held inside said exterior wall, said interior wall defining a first space and a second space held within said interior space;

at least one hole in said interior wall allows a portion of said liquid to pass through said interior wall from said first space to said second space, wherein at least a portion of said second space can be removed from said second space such that dry ice can be added to said second space.

17. The drinking vessel of claim 16 wherein the at least one hole is sized to prevent movement of a 3/16 inch diameter pellet through the hole.

18. The drinking vessel of claim 17 wherein said vessel includes an open arm at a top edge thereof, said vessel adapted for a user to drink from said open rim.

19. The drinking vessel of claim 18 wherein said vessel one piece.

20. The drinking vessel of claim 19 wherein said portion of said second space includes an integrally formed cap.

* * * * *